United States Patent [19]

Filson

[11] 4,012,106

[45] Mar. 15, 1977

[54] INSULATED TERMINAL CONSTRUCTION

[75] Inventor: John Richard Filson, Melville, N.Y.

[73] Assignee: Minnesota Mining & Manufacturing Company, St. Paul, Minn.

[22] Filed: June 20, 1975

[21] Appl. No.: 588,608

[52] U.S. Cl. ..... 339/211; 339/256 SP

[51] Int. Cl.[2] ..... H01R 11/22

[58] Field of Search ..... 339/211, 258 S, 256 SP

[56] References Cited

UNITED STATES PATENTS

| | | | |
|---|---|---|---|
| 2,158,004 | 5/1939 | Douglas | 339/220 R |
| 2,768,361 | 10/1956 | Aquillon et al. | 339/211 |
| 3,137,535 | 6/1964 | Collier et al. | 339/211 |
| 3,392,363 | 7/1968 | Geis, Jr. et al. | 339/211 |

*Primary Examiner*—Roy Lake
*Assistant Examiner*—Mark S. Bicks
*Attorney, Agent, or Firm*—Robert K. Youtie

[57] ABSTRACT

An insulated terminal including a conductor receiver barrel, an engaging element projecting from the barrel, and insulating material surrounding the barrel and engaging element.

2 Claims, 4 Drawing Figures

FIG. 1
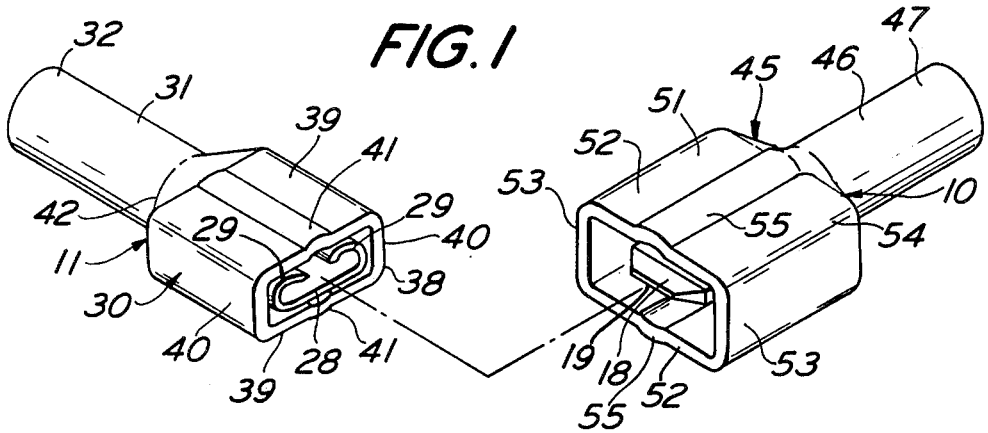
FIG. 2
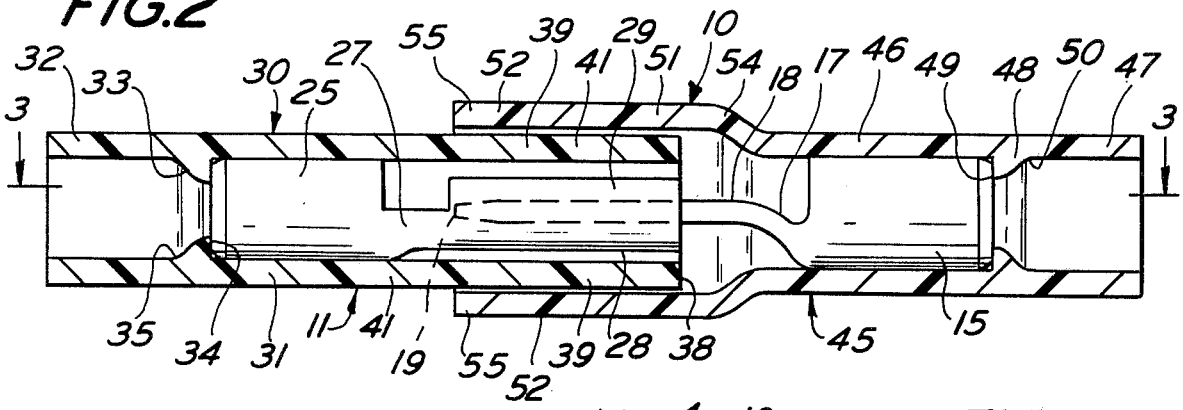
FIG. 3
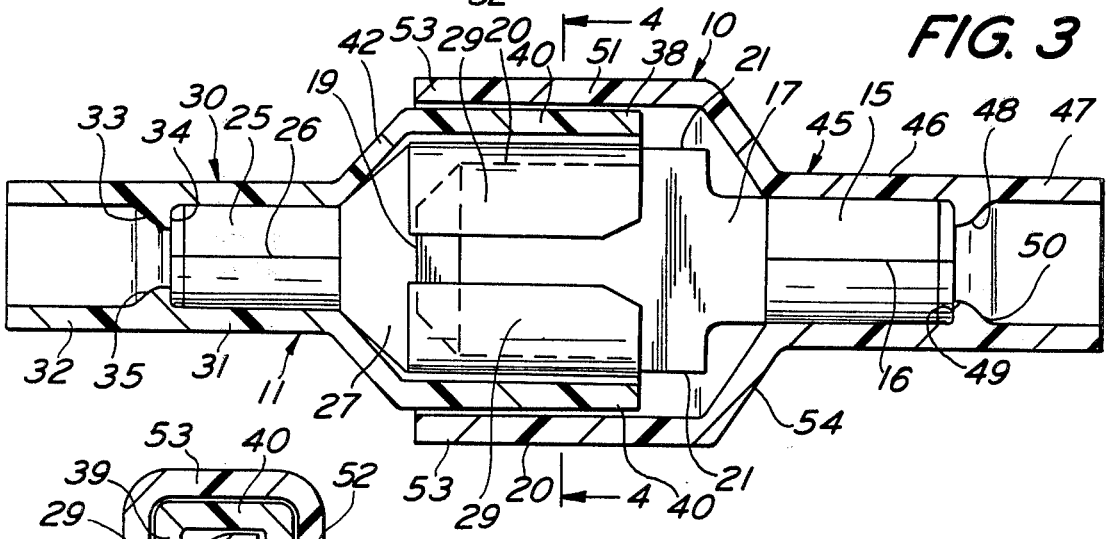
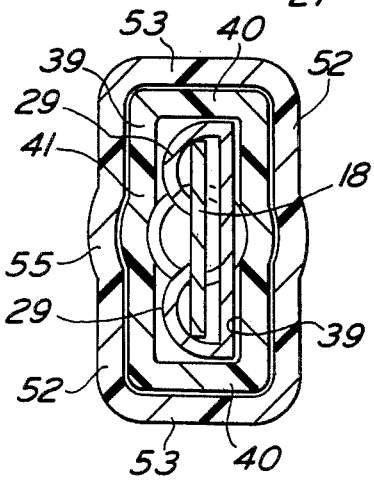
FIG. 4

INSULATED TERMINAL CONSTRUCTION

BACKGROUND OF THE INVENTION

In the field of electric wire terminals, and particularly in disconnectible terminals, it has heretofore been extremely difficult, if at all possible, to provide full insulation to the terminals. This results from the nature of disconnectible terminals wherein there is necessarily metal-to-metal contact between connected terminals which limits, or to a substantial degree precludes the use of insulating material. It has, therefore, in the past, been considered not feasible or practical to provide fully insulated disconnecting type wire terminals.

SUMMARY OF THE INVENTION

It is, therefore, an important object of the present invention to provide a unique terminal construction of the disconnecting type which is fully insulated in its operative condition, extremely simple in structure and design, and which is durable and reliable throughout a long useful life.

It is another object of the present invention to provide a disconnecting type of wire terminal having the advantageous characteristics mentioned in the preceding paragraph, which is admirably well suited for quick and easy connection to and disconnection from a mating terminal, being readily connectible and disconnectible without regard to relative terminal orientation, having a substantially self-centering action upon connecting engagement, and being adapted for substantially coaxial alignment of connected terminals.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is an exploded perspective view showing a pair of insulated terminals of the present invention in a disconnected condition.

FIG. 2 is a longitudinal sectional view showing the terminals of FIG. 1 in a connected or engaged condition.

FIG. 3 is a longitudinal sectional view taken generally along the line 3—3 of FIG. 2.

FIG. 4 is a transverse sectional view taken generally along the line 4—4 of FIG. 3.

DESCRIPTION OF THE PREFERRED EMBODIMENT

Referring now more particularly to the drawings, and specifically to FIG. 1 thereof, a pair of insulated terminals of the present invention are there respectively generally designated 10 and 11, the former being a male terminal and the latter being a female terminal. As best seen in FIGS. 2 and 3, the male terminal 10 includes a generally cylindrical wire receiver or barrel 15 having a longitudinal butt seam 16. Extending from one end of the barrel 15 on one side thereof opposite to the seam 16 may be an extension portion or neck 17 which is offset radially inwardly to terminate generally along a diametral plane of the barrel 15. This condition is shown in FIG. 2, which further shows a generally flat male engaging element or tab 18 projecting longitudinally away from the barrel 15 generally along a diametral plane of the latter and terminating in a tapered free end 19. Thus, the male engaging element or tab 19 is located generally along a center line of the barrel 15, as seen in the view of FIG. 2, and extends laterally outwardly beyond the diametral extent of the barrel 15, as between parallel side edges 20, see FIG. 3. It will also there be seen that the male engaging element, tab or spade 18 includes a pair of laterally opposed, outstanding projections or shoulders 21, respectively projecting beyond adjacent side edges 20, and spaced remote from the free end edge 19.

In practice, the male terminal cylinder 15, neck 17 and tab 18 may all be integrally fabricated of suitably conductive metal material, and the surface finished as desired. Also, the butt joint 16 may be joined, if desired, say by brazing; and, a tubular reinforcing sleeve may be engaged about the barrel 15, if desired. These and other conventional modifications are within the contemplation of the instant invention.

Interiorly of the female terminal 11, see FIGS. 2 and 3, there is a generally cylindrical, open-ended wire receiver or barrel 25 which may have a longitudinal butt seam 26. An integral extension 27 is provided on one end of the barrel 25, spaced from the seam 26, the extension being laterally flaring in the direction away from the barrel and terminating in a generally flat, substantially rectangular plate portion 28. Extending from laterally opposite, longitudinally extending side portions of the plate 28 are inturned resilient arms or wings 29. The arms or wings 29 resiliently and spacedly overlie the plate 28 and combine therewith to define a female receiver for snug frictional reception of the male engaging element 18, the connected condition shown in FIGS. 2 and 3.

The barrel 25, extension 27, plate 28 and wings 29 may all be integrally fabricated of suitably conductive metal, surface finished as desired, the seam 26 suitably joined, closed or sealed, if preferred and/or a reinforcement sleeve circumposed about the barrel 25, if such reinforcement is required.

As best seen in FIGS. 2 and 3, the female terminal barrel 25 is of a diameter greater than the transverse exterior dimension of the plate 28 and its wings 29 (see FIG. 2), and the female terminal barrel is of less diameter than the lateral extent of the plate and wings 28, 29 (seen in FIG. 3). Similarly, the male terminal barrel 15 is of a transverse dimension greater than the transverse dimension or thickness of tab 18, while of a diameter less than the lateral dimension or width of the tab.

It will be appreciated from the drawings that the male engaging element 18 is insertable into the space between the plate 28 and wings 29, which plate and wings combine to define a female engaging structure. If desired, suitable snap retention means may be provided on the male and female engaging elements 18 and 28, 29, and the shoulders 21 engageable with the open end of the female engaging structure 28, 29 to limit entry of the male element. It will be observed in both FIGS. 2 and 3 that the engaged or connected condition of the elements serves to place the barrels 15 and 25 in substantial coaxial alignment, as may be desirable in certain installations.

Surrounding the female terminal barrel 25 and female engaging structure 28, 29 is a sheath or sleeve, generally designated 30, fabricated of suitable insulating material, such as plastic, or the like. The insulating sleeve or sheath 30 includes a barrel surrounding sheath portion 31 which snugly conformably embraces the female terminal barrel 25. A cylindrical sleeve extension 32 may be provided on the barrel surrounding sleeve portion 31, extending therefrom coaxially therewith beyond the barrel 25, as for receiving wire engaged in the barrel. An internal shoulder 33 may be provided in the cylindrical sleeve extension 32, having an annular surface 34 in a plane generally normal to the barrel axis for abutting and limiting engagement with the barrel end. The shoulder 33 may be formed on its other side with an inwardly convergent surface 35 for guiding a wire conductor into the barrel 25.

In addition, the insulating tube or sleeve 30 includes a laterally enlarged, somewhat flattened portion 38 conformably surrounding the female engaging structure 28, 29. More specifically, the sleeve portion 38 is of generally rectangular cross-sectional configuration including laterally enlarged, generally parallel spaced, facing side walls 39, and laterally spaced, parallel facing edge walls 40. The spacing between edge walls 40 is considerably greater than the diameter of the barrel-receiving sleeve portion 31, while the spacing between the opposed side walls 39 is less than the diameter of the barrel receiving portion, as best seen in FIG. 1. However, the laterally medial regions of side walls 39 are distended apart from each other by opposed, generally cylindrical sector shaped portions 41, each being a longitudinal extension of respectively opposite regions of barrel-receiving sleeve portion 31.

As best seen in FIGS. 2 and 3, the female element surrounding portion 38 of insulating sleeve 30 is provided with slight clearance or spacing about the female element 28, 29, and therefore slightly movable relative to the latter. The inner end of the female element surrounding portion 38 is integrally joined, as by a reducing portion 42, to the adjacent end of barrel-receiving sleeve portion 31.

By the above-described configuration of insulating sleeve 30, it will now be apparent that the metal barrel 25 may be inserted inwardly through the female element-receiving portion 38, and particularly through the distended regions 41 into the barrel-receiving sleeve portion 31, say for snug frictional fit in the latter.

The male terminal 10 also includes an integral open-ended tubular element or sleeve, as at 45, fabricated of suitable insulating material, such as plastic and enveloping the male terminal barrel 15, neck 17 and engaging element 18. The sleeve 45 includes a generally cylindrical barrel receiving sleeve portion 46 embracingly circumposed about the barrel 15. A coaxial cylindrical extension 47 is provided on the barrel-receiving portion 46, extending therefrom beyond the barrel, and provided internally thereof with an annular shoulder 48 having an inwardly facing abutment surface 49 for limiting engagement with the barrel, and an outwardly facing convergent or tapering surface 50 for guiding engagement with a conductor wire.

Spacedly surrounding the male element 18 is a laterally enlarged, generally flat sleeve portion 51, which may be of generally rectangular cross-sectional configuration, see FIGS. 1 and 4. In particular, the male element surrounding sleeve portion 51 may include a pair of generally rectangular, laterally enlarged, opposed facing side walls 52, and extending between the adjacent pairs of side edges thereof are parallel spaced longitudinal edge walls 53. Integrally connecting the barrel surrounding sleeve portion 46 and male element surrounding sleeve portion 51 is a merging, intermediate sleeve portion 54.

Medially of the opposite side walls 52, there are distended portions 55, of opposed, partial cylindrical configuration in general alignment with the sleeve surrounding portion 46, for a purpose appearing presently.

More specifically, the male element surrounding portion 51 is configured for conforming surrounding relation with respect to the female element surrounding sleeve portion 38, the condition shown in FIG. 4, where it will appear that the distended medial wall portions 55 receive respective distended medial wall portions 41. While the male element surrounding sleeve portion 51 conformably surrounds the female element surrounding sleeve portion 38, there is advantageously slight clearance therebetween, as seen in FIGS. 2–4, to facilitate ease of connection and disconnection between male and female terminals 10 and 11.

In the connected condition, as the barrels 15 and 25 are aligned, it will be appreciated that the barrel receiving sleeve portions 46 and 31 are aligned, as are received wire conductors. Also, as the male engaging element 18 is generally on a diametral chord or center line of its barrel 15, it will be understood that the male engaging element may be readily inserted into the female engaging element 28, 29 with the parts relatively reversed, say by rotating one of the parts 180° about its axis. Further, by reason of the slight clearances afforded to the female element surrounding sleeve portion 38 and male element surrounding sleeve portion 51, and the flexibility afforded thereto by the nature of the material, it will be seen that the connector terminals are effectively self-centering for ease of connection.

While the female element surrounding sleeve portion 38 and male element surrounding sleeve portion 51 are both illustrated as terminating generally flush with the distal ends of their surrounded elements, to more effectively protect the latter from inadvertent electrical contact, it is appreciated that one or both of the surrounding sleeve portions may terminate short of its surrounded element to expose the latter for increased ease of connection without sacrificing full insulation during connection. Of course, one of the engaging elements, say the female engaging elements 28, 29 may remain fully surrounded as illustrated, while the male engaging element 18 may project beyond its surrounding sleeve portion 51 to obtain the increased ease of connection without loss of safety. That is, by standard procedures, male connecting elements are never connected to hot electrical lines so that there is no danger in the male element being exposed.

From the foregoing it is seen that the present invention provides electric wire terminal construction which is extremely simple in design, effectively fully insulates connected terminals, and otherwise fully accomplishes its intended objects.

Although the present invention has been described in some detail by way of illustration and example for purposes of clarity of understanding, it is understood that certain changes and modifications may be made within the spirit of the invention.

I claim:

1. In combination, an insulated female terminal comprising a conductor receiver female terminal barrel, a single female element extending longitudinally from said barrel terminating in an open end, and a female terminal sheath of insulating material extending about said barrel and female element; and an insulated male terminal comprising a conductor receiver male terminal barrel, a male element extending longitudinally from said male terminal barrel and terminating in a free end for mating engagement in the female element, and a male terminal sheath of insulating material extending along said male terminal barrel and spacedly surrounding said male element for encompassing said female terminal sheath when said elements are in said mating engagement, said female terminal barrel being of a diameter greater than the transverse dimension and less than the lateral dimension of said single female element, and said female terminal sheath having a barrel receiving portion and an integral female element-receiving portion, the barrel-receiving sheath portion having a diameter approximately equal to the transverse dimension of and less than the lateral dimension of said female element-receiving sheath portion, said female terminal barrel and female element being insertable into said female terminal sheath by passage of said terminal barrel through said female element-receiving sheath portion, said female terminal barrel-receiving sheath portion being generally cylindrical, and said female element sheath receiving portion being of generally flat cross-sectional configuration, opposed medial regions of said female element-receiving sheath portion being symmetrically distended to define cylindrical longitudinal extensions of said barrel-receiving sheath portion, for passage therethrough of said female terminal barrel.

2. The combination according to claim 1, said male terminal sheath having a male terminal barrel-receiving portion and an integral male element receiving portion, the male element receiving sheath portion being configured for conforming circumposition about said female terminal female element-receiving sheath portion and being distended to define symmetrically arranged cylindrical extensions to receive the cylindrical extensions of said female element-receiving sheath portion in either of 180° opposed relative positions.

* * * * *